United States Patent [19]

Petty

[11] 4,403,355

[45] Sep. 13, 1983

[54] BATHTUB DRAIN ENCLOSURE

[75] Inventor: William T. Petty, Rutherford, Tenn.

[73] Assignees: Elbert L. Petty; Lloyd F. Petty, both of Rutherford; Robert M. Petty, Kenton, all of Tenn.

[21] Appl. No.: 390,999

[22] Filed: Jun. 23, 1982

Related U.S. Application Data

[63] Continuation-in-part of Ser. No. 175,580, Aug. 5, 1980, Pat. No. 4,338,688.

[51] Int. Cl.[3] ..... E03D 11/00

[52] U.S. Cl. ..... 4/191; 4/661

[58] Field of Search ..... 4/458, 661, 559, 589, 4/193, 194, 612, 613, 538, 592, 191, 584, 595

[56] References Cited

U.S. PATENT DOCUMENTS

| | | | |
|---|---|---|---|
| 1,650,155 | 11/1927 | Randle | 4/458 X |
| 1,749,104 | 3/1930 | Kovacs | 4/458 X |
| 1,996,325 | 4/1935 | Cox | 4/458 X |
| 2,130,930 | 9/1938 | Rose | 137/362 X |
| 2,236,104 | 3/1941 | McIntosh | 137/361 |
| 2,256,780 | 9/1941 | McIntosh | 137/361 |
| 2,514,230 | 7/1950 | Feazel | 4/458 |
| 2,562,058 | 7/1951 | Oliver | 4/458 |
| 3,633,219 | 1/1972 | Byrd | 4/458 X |

*Primary Examiner*—Henry K. Artis
*Attorney, Agent, or Firm*—B. P. Fishburne, Jr.

[57] ABSTRACT

To exclude odors, drafts, insects and rodents from the necessary opening in a bathroom floor surrounding the tub drain, an open top dry enclosure box for the tub drain is placed in the floor opening in surrounding relationship to the drain components and includes an upper three-sided narrow suspension flange resting on the top floor surface. The enclosure box is provided in three of its side walls and its bottom wall with knock-out discs to provide a passageway through the enclosure box for either a horizontal or vertical drain pipe downstream from the drain trap, thereby rendering the drain box universal in its application to tub drains.

1 Claim, 4 Drawing Figures

FIG.1
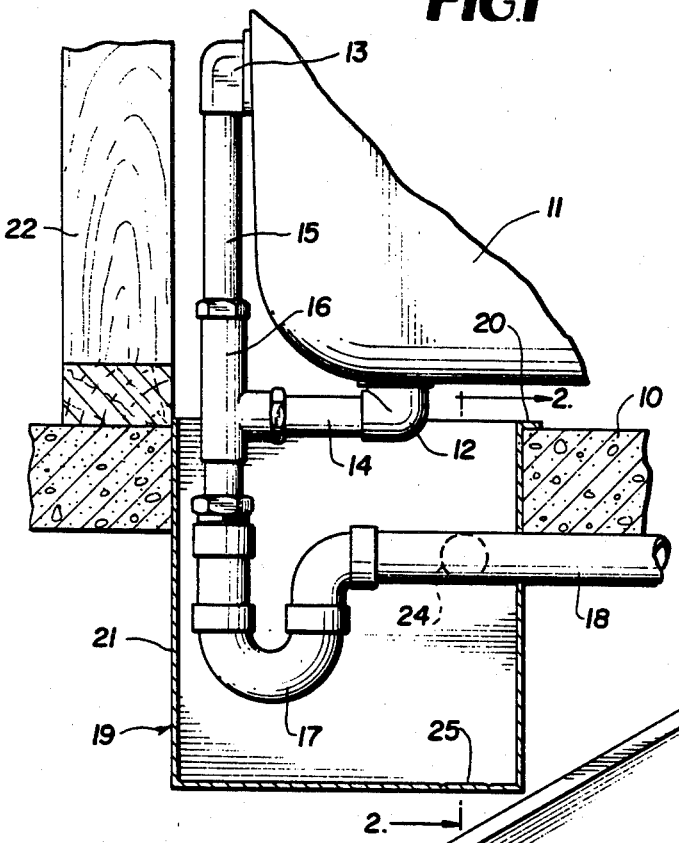
FIG.2
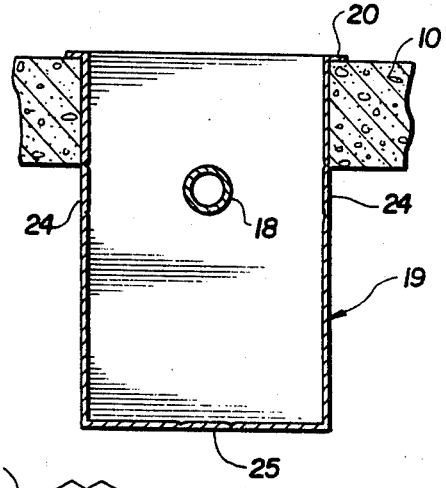
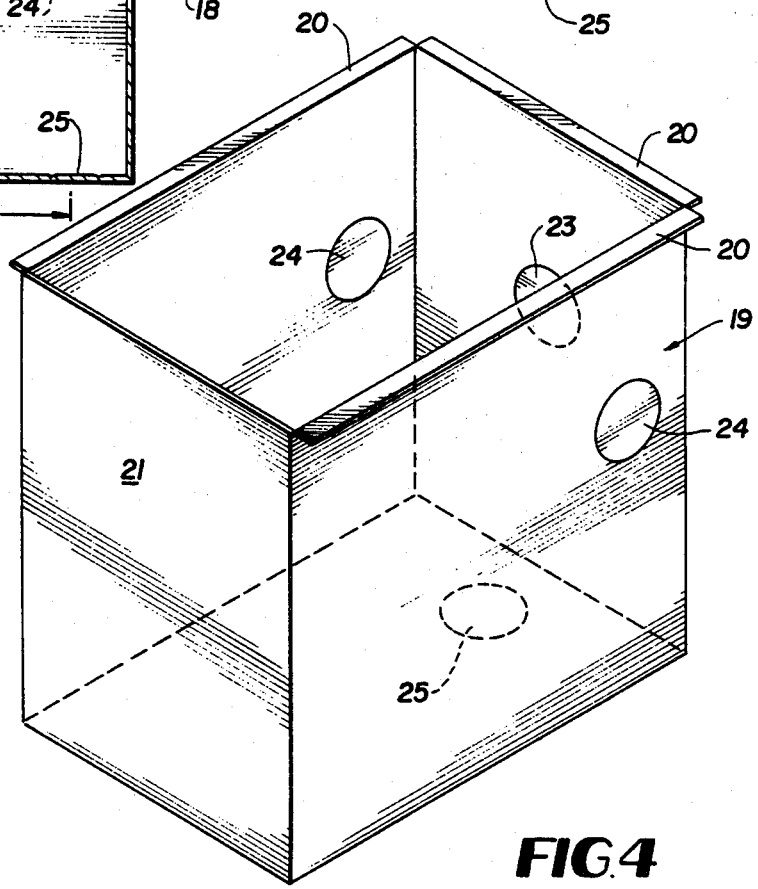
FIG.4
FIG.3
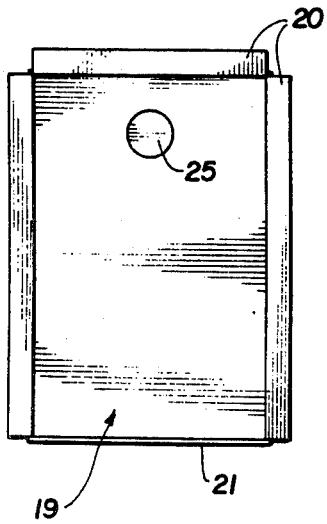

BATHTUB DRAIN ENCLOSURE

CROSS-REFERENCE TO RELATED APPLICATION

This application is a continuation-in-part of application Ser. No. 06/175,580, filed Aug. 5, 1980, for ENCLOSURE FOR TUB DRAINS, now U.S. Pat. No. 4,338,688.

BACKGROUND OF THE INVENTION

The objective of the present invention is to provide a bathtub drain enclosure of the general type disclosed in the above-referenced patent, but having greatly improved utility in the sense that the enclosure is able to accommodate tub drains whose pipes downstream from the usual U-trap extend vertically or horizontally in diverse directions. The device in the prior patent had only the capability of accommodating a vertical descending drain pipe below bathroom floor level.

The increased capability of the dry enclosure for tub drains according to the present invention is realized in a very simple and economical manner, namely, by providing knock-out discs on several vertical walls of the enclosure and at least one such disc on its bottom wall.

In general terms, the nature and objectives of the invention correspond to those stated in the referenced prior patent.

BRIEF DESCRIPTION OF THE DRAWINGS

FIG. 1 is a vertical section taken through a bathtub drain enclosure according to the invention.

FIG. 2 is a vertical section taken on line 2—2 of FIG. 1.

FIG. 3 is a plan view of the drain enclosure on a reduced scale.

FIG. 4 is a perspective view of the drain enclosure.

DETAILED DESCRIPTION

Referring to the drawings in detail wherein like numerals designate like parts, a concrete bathroom floor 10 is illustrated for the support of a bathtub 11 and other fixtures. The bathtub has a drain which includes a bottom elbow 12 near one end of the tub and an elevated overflow fitting 13 on the adjacent tub end wall. A short horizontal drain pipe 14 leads from the elbow 12 and a vertical descending drain pipe 15 leads from the fitting 13. The two perpendicular pipes 14 and 15 are connected with a common T-fitting 16, below the vertical branch of which is disposed a U-trap 17 whose downstream end is connected with a horizontal drain pipe 18. The above is one of several possible tub drain configurations which a prefabricated drain enclosure 19, according to this invention, can accommodate.

In some cases, the drain pipe downstream from the trap 17 may descend vertically, and in other cases a downstream horizontal drain pipe may extend at right angles to the position shown in FIG. 1 in either of two directions. One of the principal features of the invention is that the box-like enclosure 19 can accommodate any of the above-mentioned tub drain arrangements without difficulty, as will be fully described.

The rectangular box-like drain enclosure 19 is open at its top and is preferably formed of sturdy sheet metal for durability. As shown in the referenced prior patent, the enclosure is equipped at its top and around three sides with narrow horizontal mounting flanges 20, the flange being omitted on one side of the enclosure. The enclosure is supported on the floor 10 by means of the flanges 20 which rest on the top surface of the floor. The side wall 21 of the enclosure without a flange is placed flush with the framing 22 of the bathroom wall which is adjacent to the end of the tub 11 having the drain.

The bottom wall of the enclosure 19 is spaced well below the floor 10 to provide adequate room for any drain trap which can be encountered in the particular tub installation.

While a concrete floor 10 has been illustrated, the invention is equally applicable to a wooden floor, as shown in the referenced patent. When a concrete floor is involved, the enclosure 19 serves as a form around which concrete can be poured to create the necessary floor opening to receive the tub drain.

To enable the box-like drain enclosure 19 to be used with the horizontal pipe 18 downstream from the trap 17, a knock-out disc 23 is provided centrally in one side wall of the enclosure. The removal of the disc 23 forms a circular passageway for the pipe 18. Two similar knock-out discs 24 are provided in the two side walls of the enclosure extending at right angles to the wall 21, whereby the downstream drain pipe can be accommodated where the same extends horizontally at right angles to the illustrated position of the pipe 18 in either of two possible directions. Similarly, the bottom wall of the enclosure contains a knock-out disc 25, as shown, to make possible the use of a vertical descending drain pipe downstream from the trap 17. It can be seen that the provision of the several knock-out discs renders the tub drain enclosure substantially universal in its utility, with respect to various tub drain configurations which may be encountered in practice.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An enclosure for tub drains adapted for mounting in a floor opening adjacent to a tub drain into which opening the tub drain projects, said enclosure comprising a rectangular open top metal box having vertical side walls which extend through the floor opening and a horizontal bottom wall disposed at an elevation substantially below the floor opening and floor, said enclosure forming a protected dry compartment for tub drain components including a drain trap, a rising vertical drain pipe connected with one end of the trap and a downstream horizontal drain pipe connected with and leading away from said trap, narrow marginal horizontal support flanges for said enclosure at the top thereof and at least on three contiguous side walls of the enclosure, said flanges being adapted to rest directly on a horizontal floor surface surrounding said floor opening to thereby form the sole support for the enclosure on the floor and within the floor opening, a single vertical axis knock-out disc in the horizontal bottom wall of the enclosure near one side wall thereof and remotely spaced from the opposing side wall and spaced substantially midway between the other opposing side walls of the enclosure, and three additional knock-out discs on three vertical side walls of the enclosure at a common elevation above said bottom wall, one pair of said side wall knock-out discs being axially aligned across the enclosure and having their common axis in a substantially vertical common plane with the axis of the bottom wall knock-out disc, and the third side wall knock-out disc being provided on the side wall of the enclosure nearest to said common vertical plane and being located midway between the pair of side walls having the knock-out discs on a common axis.

* * * * *